US007470043B2

(12) United States Patent
Mehta

(10) Patent No.: US 7,470,043 B2
(45) Date of Patent: Dec. 30, 2008

(54) VENTILATION FAN AND LIGHT

(75) Inventor: Vinay Mehta, Germantown, TN (US)

(73) Assignee: Hunter Fan Company, Memphis, TN (US)

( * ) Notice: Subject to any disclaimer, the term of this patent is extended or adjusted under 35 U.S.C. 154(b) by 110 days.

(21) Appl. No.: 11/517,166

(22) Filed: Sep. 7, 2006

(65) Prior Publication Data

US 2008/0062643 A1 Mar. 13, 2008

(51) Int. Cl.
*F21V 7/00* (2006.01)

(52) U.S. Cl. ..... 362/310; 362/294; 362/295; 362/257; 362/548

(58) Field of Classification Search ..... 362/373, 362/294, 295, 264, 362, 310, 546–549
See application file for complete search history.

(56) References Cited

U.S. PATENT DOCUMENTS 2,189,008 A 2/1940 Kurth
3,786,233 A 1/1974 Bumpus et al.
3,958,100 A 5/1976 Stone
5,021,932 A * 6/1991 Ivey ..... 362/96
6,940,051 B2 * 9/2005 Tateishi ..... 219/508
2004/0084440 A1 * 5/2004 Tateishi ..... 219/508
2005/0196158 A1 * 9/2005 Semaza ..... 392/362

* cited by examiner

*Primary Examiner*—Tuyet Vo
(74) *Attorney, Agent, or Firm*—Baker Donelson et al.

(57) ABSTRACT

A ventilation fan and light (10) is disclosed which includes a housing (12) and a light kit (13). The housing (12) includes an air intake 15 adjacent the light kit and an air exhaust port (16) coupled to an exhaust duct (17). The light kit has one or more light sources (20). A motorized fan (19) is mounted within the housing. The motorized fan is operated at a low speed whenever the light source is illuminated and a high speed whenever ventilation is required. The operation of the fan at a low speed prevents the build-up of heat within the housing. The ventilation fan includes an electric circuit (22) which includes a capacitor mounted between a light source electrical branch (23) and a fan motor electrical branch (24).

2 Claims, 4 Drawing Sheets

VENTILATION FAN AND LIGHT

TECHNICAL FIELD

This invention relates to ventilation fans, and specifically to ventilation fans having a light.

BACKGROUND OF THE INVENTION

Ventilation fans having electric motors have existed for many years. Today, some ventilation fans, such as bathroom fans, include a light source. The light source however creates heat which may rise into the ventilation box or housing, which can cause an unsafe temperature situation when the box is concealed in the ceiling or attic of a house.

Accordingly, it is seen that a need remains for a ventilation fan and light combination that prevents the build up of heat within the unit. It is to the provision of such therefore that the present invention is primarily directed.

SUMMARY OF THE INVENTION

In a preferred form of the invention a ventilation fan and light comprises an electrical, motorized fan, an electrically illuminated light source, and an electrical circuit. The electrical circuit includes two electrical branches. The first branch is for the light source and includes an on/off light switch. The second branch is for the motorized fan and includes an on/off fan switch. The light source electrical branch is in parallel circuit with the fan motor electrical branch. The switches for both branches are typically located on the wall. One end of a capacitor is electrically coupled to the light source electrical branch between the light switch and the light source. The other end of the capacitor is coupled to the fan motor electrical branch between the fan switch and the motor of the motorized fan. With this construction, the capacitor provides an impedance to operate the motorized fan at a low voltage when the light switch is closed, yet does not allow the illumination of the light source if the fan switch is closed.

DETAILED DESCRIPTION

Figure 1:
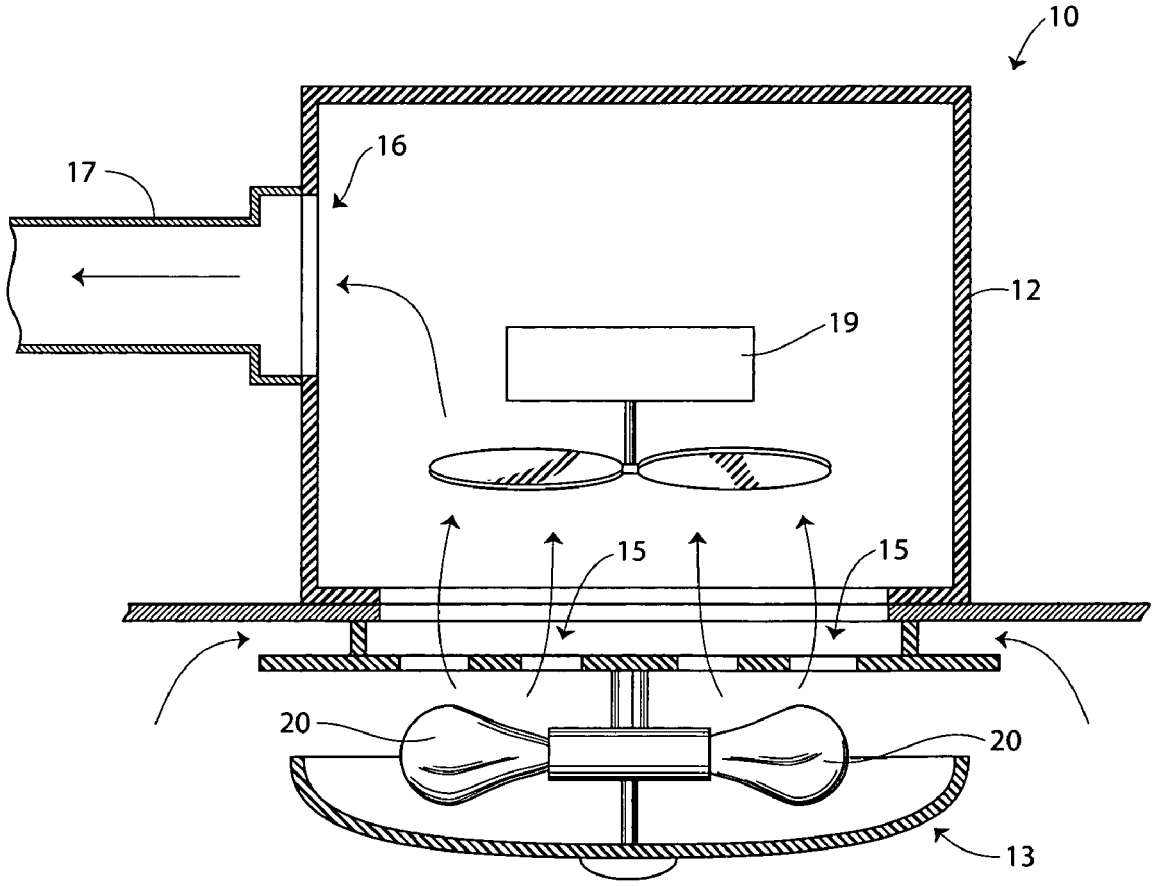
FIG. 1 is a schematic view of a ventilation fan and light embodying principles of the invention in a preferred form.

With reference next to the drawings, there is shown a ventilation fan and light 10 embodying principles of the invention in a preferred form, such as a bathroom fan and light. The ventilation fan and light is hereinafter referred to simply as ventilation fan. The ventilation fan 10 includes an enclosure or housing 12 and a light kit 13 coupled to the bottom side of the housing 12. The housing 12 is mounted within the ceiling or wall of a building structure. The housing 12 includes an air intake 15 adjacent the light kit 13 and an air exhaust port 16 coupled to an exhaust duct 17. The light kit 13 has one or more light sources 20, such as an incandescent bulb.

An electrically motorized fan 19 is mounted within the housing 12 so that air is drawn into the housing 12 through the air intake 15 and transported out of the housing through the air exhaust port 16. The motorized fan 19 is of conventional construction with an electric motor coupled to a fan blade or wheel. Preferable, air entering the housing passes closely adjacent the light source 20 of the light kit 13 so that heat produced from the light source 20 is quickly and efficiently exhausted to prevent the build-up of heat within the ventilation fan.

Figure 2:
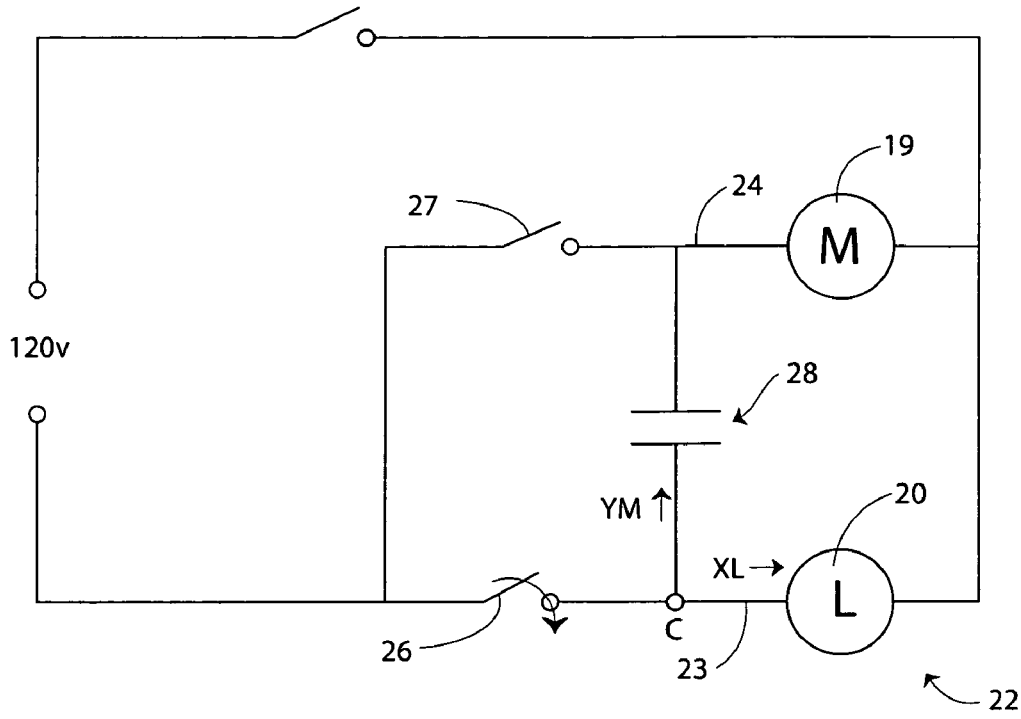
FIG. 2 is a wiring schematic of the ventilation fan and light of FIG. 1, shown with the light switch in a closed position.

The ventilation fan 10 includes an electric circuit 22 illustrated in FIG. 2. The circuit 22 includes a light source electrical conductor or branch 23 and a fan motor electrical conductor or branch 24, the light source electrical branch 23 and the fan motor electrical branch 24 are in parallel circuit with each other. The light source electrical branch 23 includes an on/off switch 26. The fan motor electrical branch 24 includes an on/off switch 27. A plastic film non-polarized AC capacitor 28 is connected between the light source electrical branch 23 and the fan motor electrical branch 24. Switches 26 and 27 are typically mounted to the wall of a structure.

The operating feature of the ventilation fan is such that the capacitor 28 forms a bypass circuit to operate the motor at a low speed continuously whenever the light source 20 is switched on through light switch 26. Due to the presence of capacitor 28 in the circuit, the speed of the motorized fan 19 is very low, typically 200 RPM (high speed is typically 1,000 to 2,000 RPM). The low speed operation of the fan creates turbulence or an airstream to exhaust the hot air from the light source within the housing via exhaust port 16 and into the exhaust duct 17. The value of the capacitor is selected such that it offers high impedance to current flowing to the fan motor and by causing a voltage drop at the fan motor input, which results in a low voltage that operates the fan motor at a low speed. The slow operation of the fan motor results in an operational noise level which is not normally detectable by a user. Furthermore, the fan is not continuously cycled on and off, with the fan operating at a full speed, instead the motorized fan runs continuously at a low speed.

When light switch 26 is closed the electric current is passed to the light source to illuminate the light source. The current flows in two directions, as illustrated by arrows XL and XM. The light source 20 receives a full supply voltage (120V) at point C by the light circuit branch. However, the motorized fan 19 does not receive a full supply voltage, as the capacitor 28 provides enough impedance to drop the voltage at the motor to a very low level, typically 20 to 40 volts. The low voltage allows the motor to run at a very low operational speed (RPM). In this case, the voltage is derived from the light circuit and not from the motor circuit.

Figure 3:
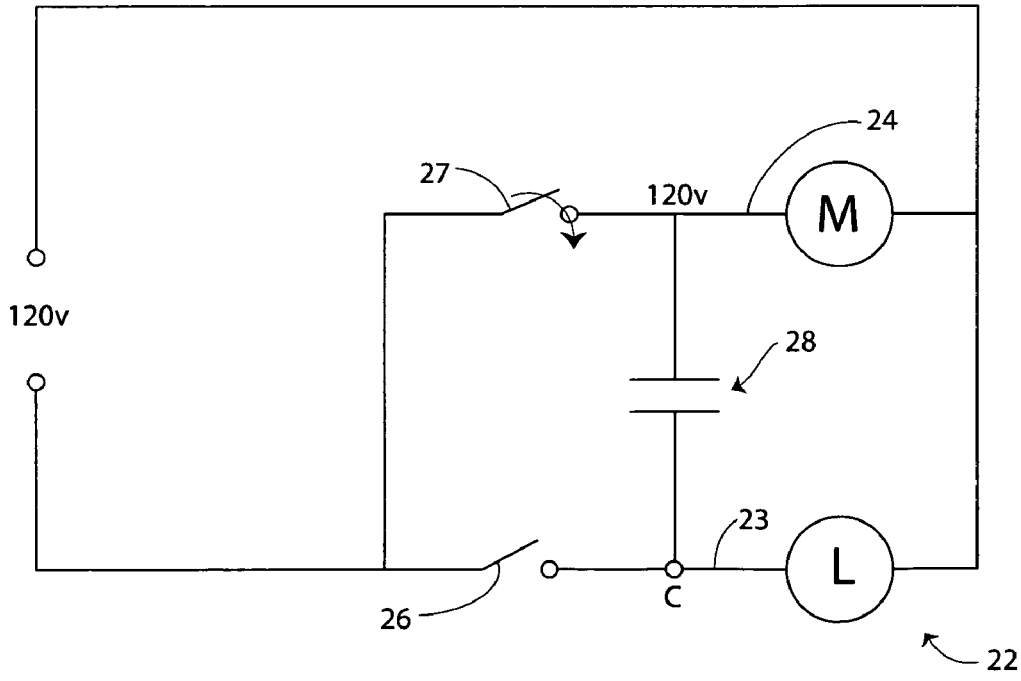
FIG. 3 is a wiring schematic of the ventilation fan and light of FIG. 1, shown with the fan motor switch in a closed position.
Figure 4:
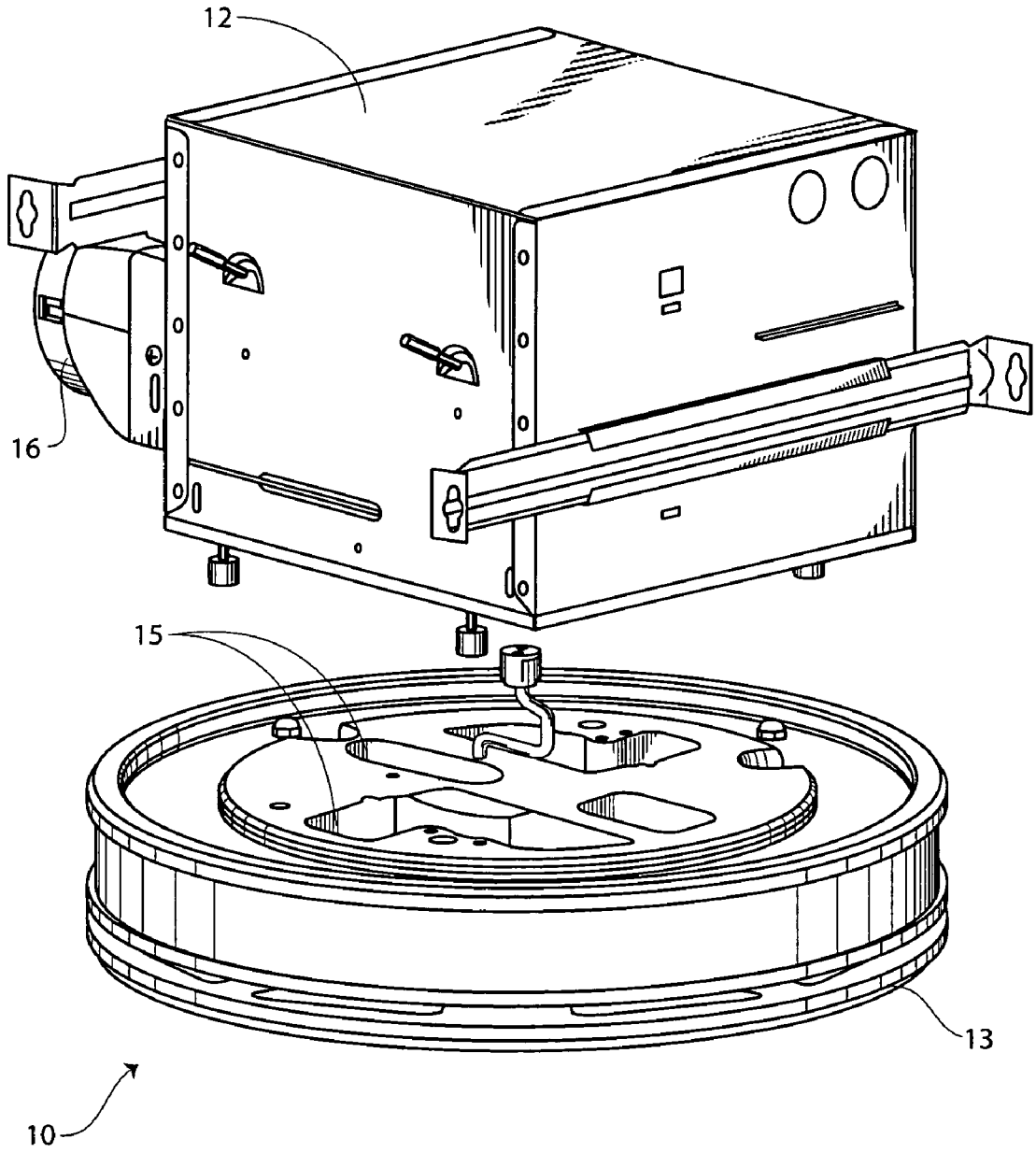
FIG. 4 is an exploded, perspective view of the ventilation fan and light of FIG. 1.
Figure 5:
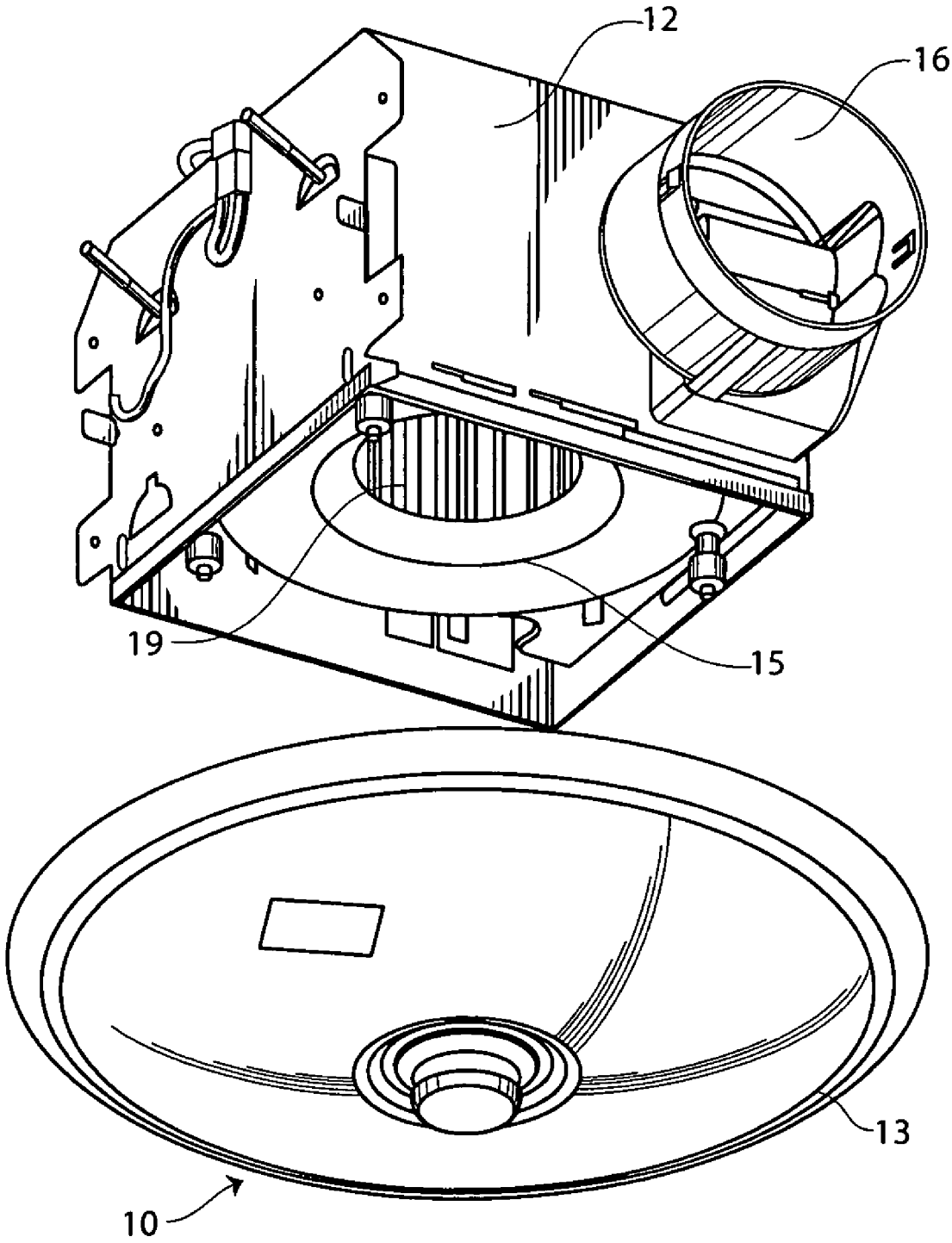
FIG. 5 is an exploded, perspective view of the ventilation fan of FIG. 1.

Referring next to FIG. 3, if the fan motor switch 27 is closed the impedance of the capacitor 28 is not effected. The voltage at the motor is 120 V and the motor operates at full speed. This voltage is directly from the motor circuit and not from the light circuit, as in the case wherein the light switch is closed.

When the light switch 26 is opened and the fan motor switch 27 is closed, the fan motor receives full voltage while the capacitor 28 and light source 20 offer high impedance to the extent that the voltage at light source 20, at location C, is not high enough to illuminate the light source 20. As such, the light source 20 is not illuminated by the voltage if only the fan motor switch 27 is closed.

When both the light switch 26 and fan switch 27 are closed, the light source 20 and motorized fan 19 both receive full voltage from their respective circuit branches and the capacitor does no provide an impedance to either the light source branch or the fan motor branch.

The novel use of a capacitor is an important feature of the electric circuitry. The capacitor reduces the speed of the fan motor by the impedance in one direction so that the motor operates at a low speed. The capacitor also provides a very high impedance to prevent the light from being illuminate should the motor switch be closed. The dual function of the capacitor in the circuit allows this operation to occur.

It thus is seen that a ventilation fan and light is now provided which overcomes problems with those of the prior art. While this invention has been described in detail with particular references to the preferred embodiments thereof, it should be understood that many modifications, additions and deletions, in addition to those expressly recited, may be made thereto without departure from the spirit and scope of the invention as set forth in the following claims.

The invention claimed is:

1. A ventilation fan comprising:

a housing;

a motorized fan mounted within said housing, said motorized fan being adapted to exhaust air from said housing;

a light source coupled to said housing:

control means for controlling the operation of the motorized fan and the light source, said control means including manually operated light switch means having an on position causing the direct energizing of said light source and an off position preventing the direct energizing of said light source and manually operated fan switch means having an on position causing the direct energizing of said motorized fan and an off position preventing the direct energizing of said motorized fan, said control means operating said motorized fan at a first speed when said light switch means is positioned in an on position and said motor switch means is positioned in an off position and said control means operating said motorized fan at a second speed higher than said first speed when said light switch means is positioned in an off position or on position and said motor switch means is positioned in an on position, whereby the operation of the motorized fan at the first speed exhausts air from the housing that is heated by the light source whenever the light source is illuminated.

2. The ventilation fan of claim 1 wherein said light switch means includes a light source electrical branch electrically coupled to said light source and including an on/off light switch, and wherein said fan switch means includes a fan motor electrical branch electrically coupled to said motorized fan and including an on/off fan switch, said light source electrical branch being in parallel circuit with said fan motor electrical branch, and a capacitor electrically coupled between said light source electrical branch and said fan motor electrical branch, said capacitor being coupled to said light source electrical branch between said light switch and said light source, and said capacitor being coupled to said fan motor electrical branch between said fan switch and said motorized fan, whereby the capacitor provides an impedance to operate the motorized fan at a low voltage when the light switch is closed, yet does not allow the illumination of the light source if the fan switch is closed.

* * * * *